US010821368B2

(12) United States Patent
Hall et al.

(10) Patent No.: US 10,821,368 B2
(45) **Date of Patent: *Nov. 3, 2020**

(54) RIDE WITH ROTATING LIFT

(71) Applicant: Universal City Studios LLC, Universal City, CA (US)

(72) Inventors: Gregory S. Hall, Orlando, FL (US); Dwain South, Orlando, FL (US); David Goodwin, Orlando, FL (US); Carlos Weiser, Orlando, FL (US)

(73) Assignee: Universal City Studio LLC, Universal City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/518,748

(22) Filed: Jul. 22, 2019

(65) Prior Publication Data

US 2019/0344186 A1 Nov. 14, 2019

Related U.S. Application Data

(62) Division of application No. 15/882,820, filed on Jan. 29, 2018, now Pat. No. 10,398,989.

(51) Int. Cl.

| | |
|---|---|
| ***A63G 1/10*** | (2006.01) |
| ***A63G 1/24*** | (2006.01) |
| ***A63G 31/16*** | (2006.01) |

(52) U.S. Cl.

CPC ..... *A63G 1/10* (2013.01); *A63G 1/24* (2013.01); *A63G 31/16* (2013.01)

(58) Field of Classification Search

CPC . A63G 1/10; A63G 1/24; A63G 31/16; E04H 12/344

See application file for complete search history.

(56) References Cited

U.S. PATENT DOCUMENTS

| | | | |
|---|---|---|---|
| 706,891 | A | 8/1902 | Bramhall |
| 1,750,857 | A | 3/1930 | Patterson |
| 3,394,505 | A | 7/1968 | Rife |
| 3,905,166 | A | 9/1975 | Kaiser |
| 5,628,690 | A | 5/1997 | Spieldiener |

(Continued)

FOREIGN PATENT DOCUMENTS

| | | |
|---|---|---|
| CN | 100575645 | 12/2009 |
| CN | 104278858 | 1/2015 |

(Continued)

OTHER PUBLICATIONS

PCT/US2019/014869 International Search Report and Written Opinion dated Jul. 1, 2019.

(Continued)

*Primary Examiner* — Michael D Dennis

(74) *Attorney, Agent, or Firm* — Fletcher Yoder, P.C.

(57) ABSTRACT

A method of transporting a ride vehicle in an amusement park ride includes moving the ride vehicle vertically along a frame to a height using a motion base lift assembly, rotating, using a base, the ride vehicle around an attraction tower, in which the attraction tower comprising a plurality of rooms and the base is configured to rotate about the attraction tower and is attached to the frame. The method also includes extending the ride vehicle into a room of the plurality of rooms via the motion base lift assembly.

16 Claims, 6 Drawing Sheets

(56) References Cited

U.S. PATENT DOCUMENTS

| | | | | |
|---|---|---|---|---|
| 5,765,314 | A | 6/1998 | Giglio et al. | |
| 5,947,828 | A | 9/1999 | Fabbri | |
| 5,964,666 | A | 10/1999 | Uemura | |
| 5,989,127 | A | 11/1999 | Kitchen et al. | |
| 6,004,091 | A | 12/1999 | Roth | |
| 6,022,276 | A | 2/2000 | Knijpstra | |
| 6,076,638 | A | 6/2000 | Gertz | |
| 6,126,550 | A | 10/2000 | Moser | |
| 6,128,863 | A | 10/2000 | Millay | |
| 6,220,965 | B1 | 4/2001 | Hanna | |
| 6,280,341 | B1 | 8/2001 | Hayashi | |
| 6,462,769 | B1 | 10/2002 | Trowbridge | |
| 6,629,895 | B2 | 10/2003 | Uemura | |
| 6,796,908 | B2 | 9/2004 | Weston | |
| 7,614,958 | B2 | 11/2009 | Weston | |
| 7,922,594 | B2 | 4/2011 | Verl | |
| 7,955,168 | B2 | 6/2011 | Mendelsohn | |
| 7,971,537 | B2 | 7/2011 | Verl | |
| 8,057,317 | B2 | 11/2011 | Roodenburg | |
| 8,206,230 | B2 | 6/2012 | Magpuri | |
| 8,225,555 | B2 | 7/2012 | Magpuri | |
| 8,490,549 | B2 | 7/2013 | Kitchen | |
| 8,491,403 | B2 | 7/2013 | Schreibfeder | |
| 8,578,857 | B2 | 11/2013 | Crawford et al. | |
| 8,992,336 | B2 | 3/2015 | Magpuri | |
| 9,016,210 | B2 | 4/2015 | Kitchen | |
| 9,149,728 | B2 | 10/2015 | Beyr | |
| 9,162,150 | B2 * | 10/2015 | Roodenburg | A63G 7/00 |
| 9,242,181 | B2 | 1/2016 | Vatcher | |
| 9,259,657 | B2 | 2/2016 | Vatcher | |
| 9,266,028 | B2 | 2/2016 | Alfieri | |
| 9,463,379 | B1 | 10/2016 | Brister | |
| 9,463,391 | B2 | 10/2016 | Job et al. | |
| 9,540,832 | B2 | 1/2017 | Magpuri | |
| 9,542,011 | B2 | 1/2017 | Huang | |
| 9,586,151 | B1 | 3/2017 | Boyle | |
| 9,675,894 | B2 | 6/2017 | Vatcher | |
| 9,744,469 | B2 | 8/2017 | Kitchen | |
| 9,827,489 | B2 | 11/2017 | Yale | |
| 9,958,767 | B1 | 5/2018 | Reichow | |
| 10,279,274 | B1 * | 5/2019 | Brister | A63G 1/30 |
| 2007/0265103 | A1 * | 11/2007 | Roodenburg | A63G 31/02 472/43 |
| 2013/0059670 | A1 * | 3/2013 | Crawford | A63G 1/00 472/36 |
| 2015/0065260 | A1 | 3/2015 | Beyer | |
| 2016/0089610 | A1 | 3/2016 | Boyle | |
| 2016/0175720 | A1 | 6/2016 | Vatcher et al. | |
| 2016/0279529 | A1 | 9/2016 | Kitchen | |
| 2017/0225084 | A1 | 8/2017 | Snyder | |
| 2018/0008897 | A1 | 1/2018 | Ackley | |
| 2018/0015377 | A1 | 1/2018 | Kitchen | |
| 2018/0033199 | A9 | 2/2018 | Eatedali | |
| 2018/0253905 | A1 | 9/2018 | McCracken | |
| 2018/0311588 | A1 | 11/2018 | Beumers | |

FOREIGN PATENT DOCUMENTS

| | | |
|---|---|---|
| CN | 104278859 | 1/2015 |
| CN | 104278860 | 1/2015 |
| CN | 104278861 | 1/2015 |
| CN | 104436664 | 3/2015 |
| CN | 204337733 | 5/2015 |
| CN | 204469247 | 7/2015 |
| CN | 105005321 | 10/2015 |
| DE | 19724273 | 12/1998 |
| DE | 19925851 | 4/2001 |
| DE | 202013001239 | 5/2014 |
| WO | 2011042015 | 4/2011 |
| WO | 2012016416 | 2/2012 |
| WO | 17091076 | 6/2017 |

OTHER PUBLICATIONS

Youtube, "African Jungle Lift" Website: https://www.youtube.com/watch?v=AjoQZU3zVUs (Accessed on Jul. 20, 2017).

Intamin Amusement Rides, "Ultra Tower Multi Drop TowerIImmersive Simulator" Website: llttps:!twww.intaminworldwide com/project/ultra-tower-2/, (Accessed on Jan. 3, 2018).

Blog at WordPress.com, "The Tech of the Tower of Terror", Website: https://eeyoreandhs.wordpress.com/2011/04/18/the-tech-of-the-tower-of-terror/, Apr. 18, 2011.

Robert Niles, "Weekly Top 10: The World's Best Drop Rides", Website: http://www.themeparkinsider.com/flume/201501/4369/, Jan. 12, 2015.

Wikipedia, "The Twilight Zone Tower of Terror", Website: https://en.wikipedia.org/wiki/The_Twilight_Zone_Tower_of_Terror, Oct. 10, 2018.

* cited by examiner

RIDE WITH ROTATING LIFT

CROSS REFERENCE TO RELATED APPLICATIONS

This application is a divisional of and claims priority to U.S. patent application Ser. No. 15/882,820, entitled "RIDE WITH ROTATING LIFT," filed Jan. 29, 2018, which is herein incorporated by reference in its entirety for all purposes.

BACKGROUND

The present disclosure relates generally to the field of amusement park rides. More specifically, embodiments of the present disclosure relate to a lift system for transporting a ride vehicle from one location to another.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Amusement parks include a variety of features providing unique experiences to each park guest. Some features may include a ride vehicle that may travel along a specific path. The path may include elements such that as the ride vehicle travels along the path, those elements may enhance a guest's experience. For example, the ride vehicle may enter and exit several rooms when traveling along the path, where there are elements inside of each room to enhance a guest's experience.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a method of transporting a ride vehicle in an amusement park ride includes moving the ride vehicle vertically along a frame to a height using a motion base lift assembly, rotating, using a base, the ride vehicle around an attraction tower, in which the attraction tower having a plurality of rooms and the base is configured to rotate about the attraction tower and is attached to the frame. The method also includes extending the ride vehicle into a room of the plurality of rooms via the motion base lift assembly.

In an embodiment, a controller includes a tangible, non-transitory, computer-readable medium with computer-executable instructions that, when executed, are configured to cause one or more processors to control rotation of a ride vehicle around an attraction tower of an attraction system, in which the attraction tower includes a plurality of rooms, control movement of the ride vehicle vertically along a frame of the attraction system using a motion base lift assembly to align the ride vehicle with a room of the plurality of rooms, and control extension of the ride vehicle into the room via the motion base lift assembly.

In an embodiment, a method, includes moving a plurality of ride vehicles along a respective frame, in which each respective frame is coupled to a base, rotating the base around an attraction tower having a plurality of rooms, in which rotating the base rotates the plurality of ride vehicles around the attraction tower, inserting a first ride vehicle of the plurality of ride vehicles into a first room of the plurality of rooms, inserting a second ride vehicle of the plurality of ride vehicles into a second room of the plurality of rooms, and withdrawing the first ride vehicle from the first room while maintaining the second ride vehicle in the second room.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
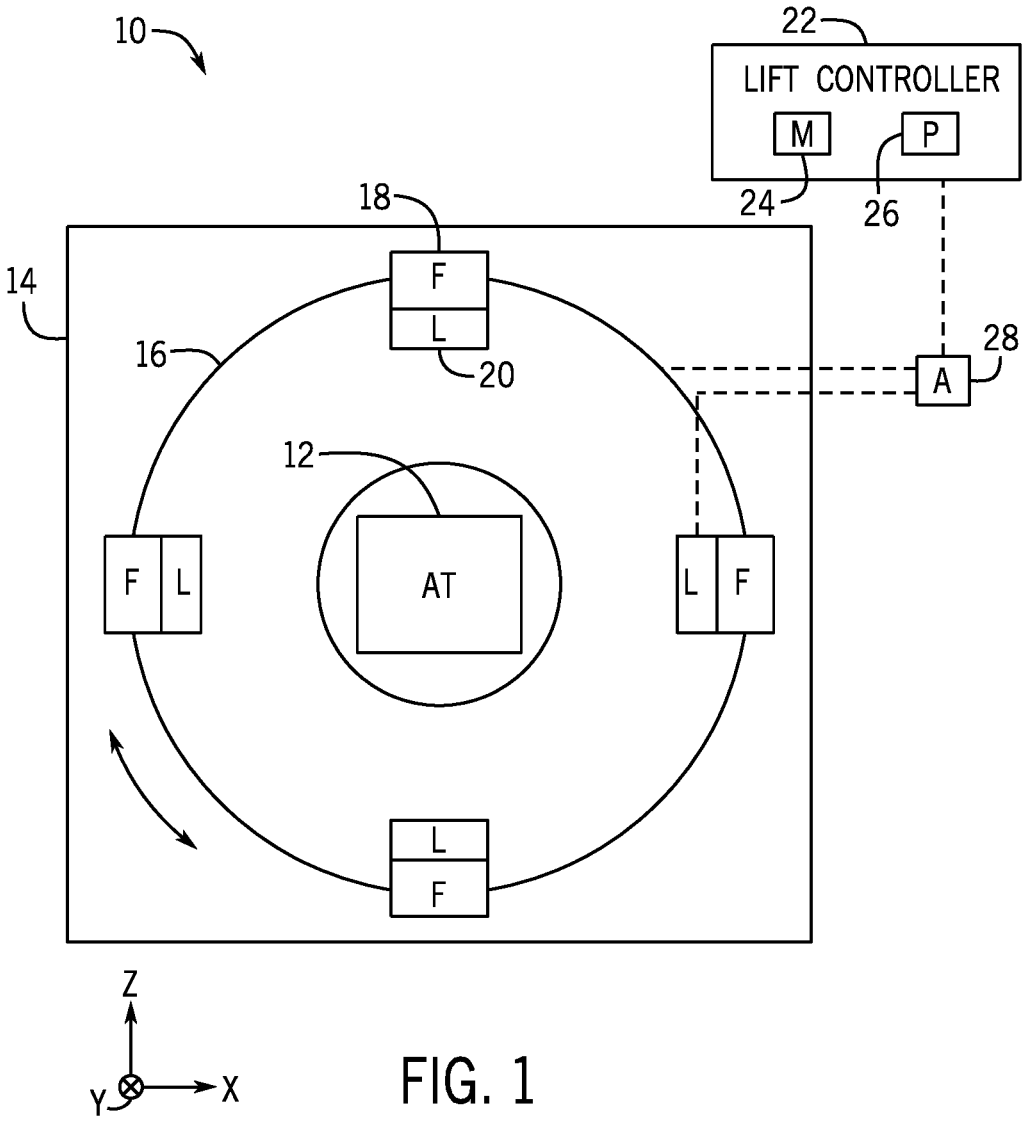
FIG. 1 is a plan view of an embodiment of a ride system that includes a rotating lift system, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure are directed to a ride system that uses a lift system to transport ride vehicles from one room of the ride system to another room of the ride system. The rooms may be at a different vertical positions with respect to one another, and the lift system may change the positions of the ride vehicles to be at the same vertical position as one of the rooms. The lift system may also move the ride vehicles into and out of each room. Each room may include show elements to enhance the experience of guests on the ride system. Therefore, as guests move into each room in the ride vehicle, they encounter the different show elements. Additionally, the ride system may move in multiple degrees of freedom to provide certain sensations that would not otherwise be possible (or would be significantly diminished) by a system with only one degree of freedom (e.g., vertical movement). Furthermore, the ride system may permit a greater number of possible paths for the ride vehicle to take and thereby, create the possibility of providing a different experience for each guest.

The ride system of the present disclosure may have several ride vehicles surrounding a tower of rooms. The ride system may include a lift system that moves the ride vehicles into the rooms. In one embodiment, the lift system moves a ride vehicle vertically to align the ride vehicle with a height of one of the rooms. Then the lift system rotates the ride vehicle to align the ride vehicle with an opening of the room and then inserts the ride vehicle into the room through the opening.

Throughout operation of the ride system, the lift system may move and/or rotate the ride vehicle several times to insert the ride vehicle into different rooms and/or different openings of a room. Each room of the ride system may include show elements such as props (e.g., animatronics) and/or displays (e.g., projected images) that enhance guest experience when the ride vehicle enters the room. Different rooms may include different show elements to provide unique experiences to guests. Additionally, a room may include different show elements at different time intervals of the ride system. For example, when the ride vehicle enters the room for a first time, the show elements may include several images on walls of the room. When the ride vehicle enters the room for a second time, the images may be removed but there may be several animatronics in the room.

As such, the ride system described herein may be used to enhance a guest's experience in a number of different ways. For example, the ride vehicle may move in numerous degrees of freedom, such as rotational and translational movement, that may generate sensations felt by guests on the ride vehicle. Furthermore, the ride vehicle may enter and exit rooms in the ride system, where the rooms include show elements that may further enhance guest experience. The combination of movement by the ride system and the show elements in each room may create a variety of guest experiences and permit different possible ride routes. Components and operations of the ride system will be further discussed below.

Turning to the drawings, FIG. 1 is a plan view of an embodiment of a ride system 10 that may be located in an amusement park. As illustrated in FIG. 1, the ride system 10 includes an attraction tower 12 disposed within an enclosure 14. The attraction tower 12 may extend in a y-direction (i.e., a vertical direction) towards a ceiling of the enclosure 14. In one embodiment, the attraction tower 12 may be located substantially at the center of the enclosure 14. Within the enclosure 14, a base 16 may surround the attraction tower 12. The base 16 may rotate around the attraction tower 12 while the attraction tower 12 remains in a stationary position (e.g., the attraction tower 12 does not rotate). In one embodiment, the base 16 may be circular and include a hole in its center, in which the attraction tower 12 may be located. In this manner, the base 16 may rotate independently from the attraction tower 12. For example, the attraction tower 12 may be coupled to a section of the enclosure 14 (e.g., at the bottom of the enclosure 14) that does not rotate and the base 16 may couple to a section of the enclosure 14 that does rotate. In one embodiment, the base 16 may be capable of rotating in either or both a clockwise and counterclockwise direction around the attraction tower 12.

The base 16 may include a frame 18, arranged as a vertical column extending in the y-direction towards the ceiling of the enclosure 14. The frame 18 may be coupled to the base 16 such that rotation of the base 16 drives the frame 18 to revolve around the attraction tower 12. The frame 18 may remain stationary relative to the base 16. Furthermore, the frame 18 may be coupled with a motion base lift assembly 20. The motion base lift assembly 20 is configured to move along the vertical column of the frame 18 (i.e., in the y-direction) and thereby change its vertical position. In one embodiment, the vertical column of the frame 18 may be a rectangular shape and the motion base lift assembly 20 may be coupled to a side of the vertical column of the frame 18. In this manner, the rotation of the base 16 may also result in the revolution of the motion base lift assembly 20 around the attraction tower 12.

A lift controller 22 may be communicatively coupled to show elements of the ride system 10 to control the movement of the components of the ride system 10. The lift controller 22 may be located within the enclosure 14, such as in the attraction tower 12, or may be located outside of the enclosure 14. The lift controller 22 may include a memory 24 with stored instructions for controlling either or both the base 16 and the motion base lift assembly 20. In addition, the lift controller 22 may include a processor 26 configured to execute such instructions. For example, the processor 26 may include one or more application specific integrated circuits (ASICs), one or more field programmable gate arrays (FPGAs), one or more general purpose processors, or any combination thereof. Additionally, the memory 24 may include volatile memory, such as random access memory (RAM), and/or non-volatile memory, such as read-only memory (ROM), optical drives, hard disc drives, or solid-state drives.

During operation of the ride system 10, the lift controller 22 may control movement of the base 16 and/or the movement of the motion base lift assembly 20. For example, the lift controller 22 may transmit signals to actuators 28 that cause the base 16 to rotate. In one embodiment, the lift controller 22 may cause rotation of the base 16 in a clockwise direction at a first time interval during operation of the ride system 10 and in a counterclockwise direction at a second time interval during operation of the ride system 10. Furthermore, the lift controller 22 may activate actuators 28 that are configured to move the motion base lift assembly 20 along the vertical column of the frame 18. As an example, the lift controller 22 may activate the actuators 28 to raise the height of the motion base lift assembly 20 to a higher vertical position. The lift controller 22 may also be configured to rotate the base 16 and move the motion base lift assembly 20 simultaneously. In one embodiment, the instructions may be programmed such that the movement of the components is predetermined during operation of the ride system 10.

In one embodiment of the ride system 10, there may be multiple frames 18 coupled to the base 16, each coupled to an associated motion base lift assembly 20. Although FIG. 1 depicts four frames 18 and four motion base lift assemblies 20 coupled to the base 16 in an evenly spaced manner around the attraction tower 12, there may any number of frames 18 and motion base lift assemblies 20 coupled to the base 16 in any suitable arrangement. Furthermore, there may be multiple lift controllers 22. As an example, each lift controller 22 may control a respective motion base lift assembly 20. However, in certain embodiments, a single lift controller 22 may control movement of all of the motion base lift assemblies 20 and the movement of the base 16. Moreover, the base 16, the attraction tower 12, and the enclosure 14 may be of any suitable shape.

Figure 2:
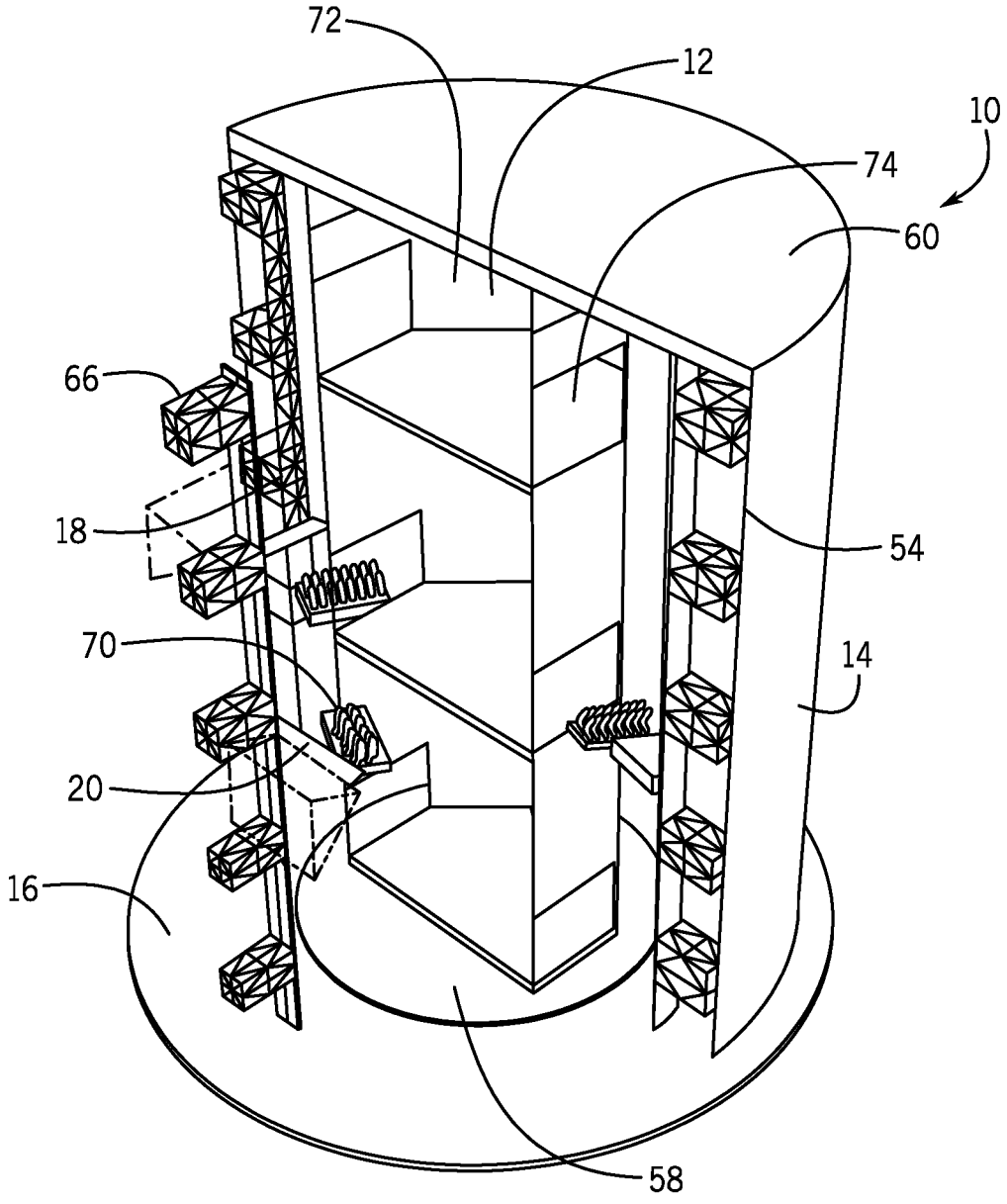
FIG. 2 is a cutaway perspective view of an embodiment of the ride system of FIG. 1, in accordance with an aspect of the present disclosure.

To further demonstrate the components and movement, FIG. 2 is a cutaway perspective view of an embodiment of the ride system 10. The ride system 10 includes an embodiment of the enclosure 14 that is shown to be cylindrical in shape defined by a wall 54 (e.g., an outer wall). Within the center of the enclosure 14, the attraction tower 12 extends from a bottom 58 of the enclosure 14 up near a ceiling 60 of the enclosure 14. The base 16 may surround a lower portion (e.g., a portion of the bottom 58) and the base 16 may be configured to rotate while the bottom 58 and the attraction tower 12 remain stationary. The enclosure 14 may also remain stationary while the base 16 rotates. Although FIG. 2 depicts the base 16 as in contact with the enclosure 14, in one embodiment, the base 16 may not be coupled to the enclosure 14.

The frame 18 may couple to the base 16 and extend vertically towards the ceiling 60. In FIG. 2, the frame 18 is shown to be a rectangular vertical column, but in another embodiment, the frame 18 may be another shaped vertical column. In a further embodiment, the frame 18 may be a different structure type (e.g., bundled tube structure) that may include the vertical column extending towards the ceiling 60. In one embodiment, the frame 18 may be the same height as the attraction tower 12. As discussed above, the frame 18 may be coupled to the base 16 such that rotation of the base 16 also results in revolution of the frame 18 around the attraction tower 12. To stabilize the frame 18, there may be several posts 66 extending from the frame 18 towards the wall 54. The posts 66 may be in contact with the inside of the wall 54 to keep the frame 18 from moving (e.g., leaning).

As mentioned, the associated motion base lift assembly 20 may move along the frame 18 to adjust its vertical position. Furthermore, the motion base lift assembly 20 may include a ride vehicle 70, where the ride vehicle 70 may include seating for guests using the ride system 10. The ride vehicle 70 may be disposed on the motion base lift assembly 20 in such a manner that the ride vehicle 70 may move relative to the frame 18. For example, in addition to changing its vertical position when the motion base lift assembly 20 moves along the frame 18, the ride vehicle 70 may also rotate or move laterally (e.g., closer to the center of the enclosure 14).

Movement of the motion base lift assembly 20 and of the ride vehicle 70 may position the ride vehicle 70 into one of the rooms 72 in the attraction tower 12. As an example, there may be several rooms 72 stacked atop of one another in the attraction tower 12, each with openings 74. The motion base lift assembly 20 may change the vertical position of the ride vehicle 70 to match the height of the ride vehicle 70 with the height of one of the rooms 72. The ride vehicle 70 may also be rotated to face the room 72, then moved laterally (e.g., extended towards the room 72) to enter the room 72 through the opening 74. In one embodiment, the rooms 72 may be rectangular and include openings 74 on one or more sides. The ride vehicle 70 may then enter any of the rooms 72 through any of the openings 74. For example, the lift controller 22 may activate actuators 28 (FIG. 1) to move the motion base lift assembly 20 to align the vertical position of the ride vehicle 70 with the room 72, rotate the base 16 to align the ride vehicle 70 with the opening 74, then rotate and extend the ride vehicle 70 into the room 72. In one embodiment, there may be several frames 18 coupled to the base 16 and thus, several motion base lift assemblies 20 and ride vehicles 70 associated with the frames 18.

Figure 3:
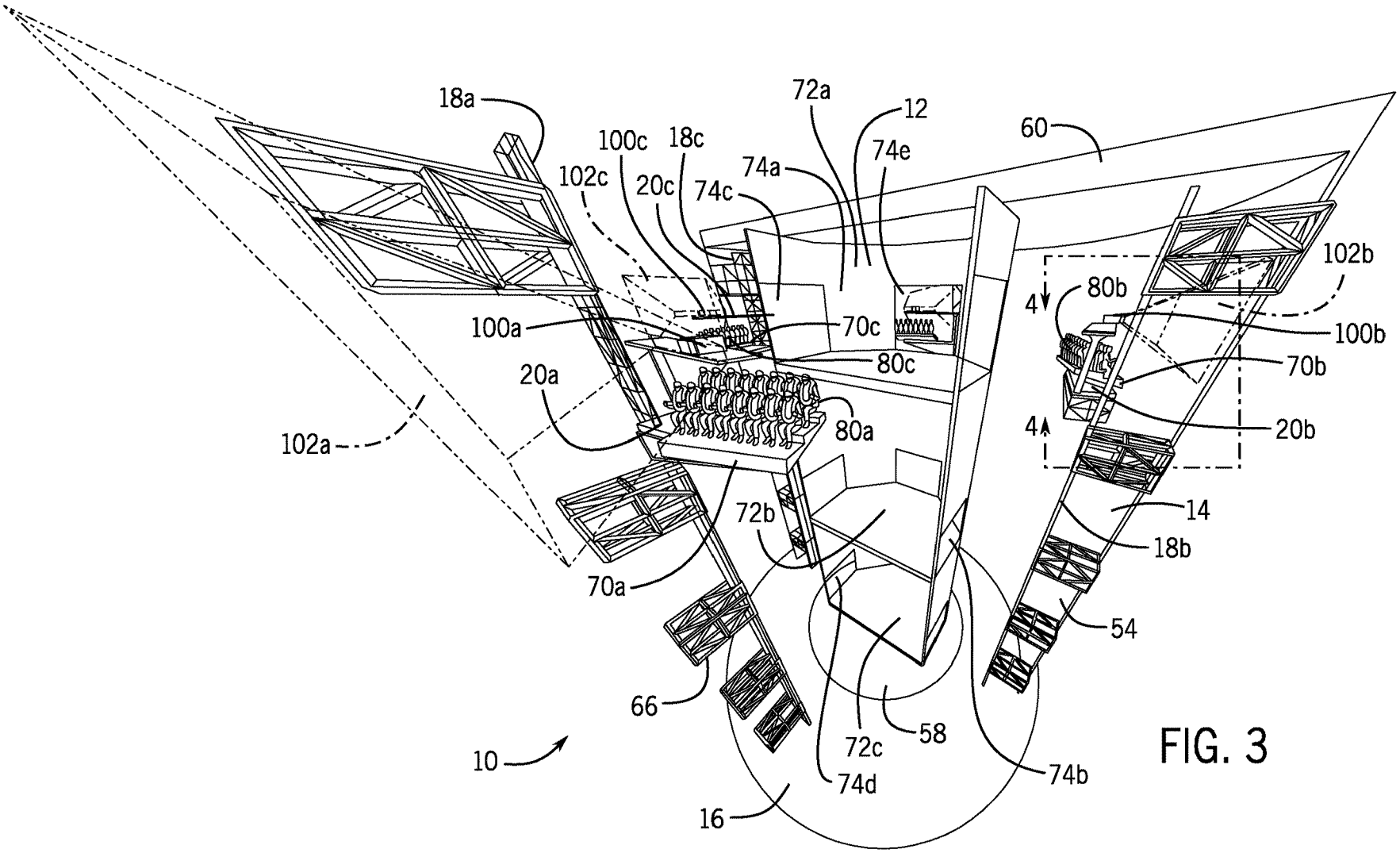
FIG. 3 is a cutaway perspective view of an embodiment of the ride system of FIG. 2 having a motion base lift assembly, in accordance with an aspect of the present disclosure.

In one embodiment, the motion base lift assemblies 20 and/or the ride vehicles 70 may move independently from one another. FIG. 3 is a cutaway perspective view of the ride system 10 with several frames 18 coupled to the base 16 and a corresponding one of the motion base lift assemblies 20 coupled to each frame 18. In particular, FIG. 3 depicts, in detail, multiple frames 18*a*, 18*b*, 18*c* within the enclosure 14, each extending from the base 16 to the ceiling 60. Each frame 18 includes posts 66 that extend outwards towards the wall 54 and each frame 18 couples to a respective motion base lift assembly 20*a*, 20*b*, 20*c* that includes a corresponding ride vehicle 70*a*, 70*b*, 70*c*, each including respective passengers 80*a*, 80*b*, and 80*c*. Furthermore, the attraction tower 12 disposed in the center of the enclosure 14 includes multiple rooms 72*a*, 72*b*, and 72*c* stacked atop one another, where room 72*a* is located most proximate to the ceiling 60 (i.e., at the highest vertical position), room 72*c* is located most proximate to the bottom 58, and room 72*b* is between room 72*a* and room 72*c*.

As noted above, the base 16 may rotate, the motion base lift assemblies 20 may move along their respective frames 18, and the ride vehicles 70 may move, for example, to position the ride vehicles 70 into one of the rooms 72 in the attraction tower 12. In one embodiment, movement of the motion base lift assemblies 20 and/or movement of the ride vehicles 70 may be performed independently of one another. As an example, the motion base lift assembly 20*a* may be raised toward the ceiling 60 and the motion base lift assembly 20*b* may be lowered toward the bottom 58 simultaneously. Meanwhile, the motion base lift assembly 20*c* may remain stationary at its current position. In this manner, at any given time, the motion base lift assemblies 20 may be at different respective vertical positions relative to one another.

The ride vehicles 70 may also be moved independently. For instance, the ride vehicle 70*a* may be rotated to face the attraction tower 12 and simultaneously, the ride vehicle 70*b* may be rotated to face the wall 54. While the ride vehicles 70*a*, 70*b* are rotating, motion base assembly 20*c* may be moving to adjust the height of the ride vehicle 70*c*. Thus, each ride vehicle 70 may be moving to a different position and moving in a different manner during operation of the ride system 10.

Each ride vehicle 70 may also be associated with a respective projector 100 (shown as 100*a*, 100*b*, 100*c*), which projects an associated image 102*a*, 102*b*, 102*c*. The projectors 100 may project the images 102 onto an inside surface of the wall 54 such that when the ride vehicles 70 are rotated so that the passengers 80 face the wall 54, the passengers 80 may view the image 102. The projectors 100 may further enhance guest experience by providing entertainment while the motion base lift assemblies 20 adjust the positions of the ride vehicles 70. As an example, when the motion base lift assemblies 20 are moving in a vertical direction, the ride vehicles 70 may be rotated to face the wall 54. The projector 100 may project the image 102 to show a bird's eye view of a scenery to simulate movement through a landscape. Further, each projector 100 may project images 102 that are different from one another. For example, the image 102*a* may be of a landscape of a desert, the image 102*b* may be a landscape of a forest, and the image 102*c* may be a landscape of a mountain. In addition, since each ride vehicle 70 may be experiencing a different movement through the ride system 10, each projector 100 may be activated by the lift controller 22 at different times to correspond with movement of the ride vehicles 70. Thus, the guest experience in each ride vehicle 70 may be different from one another.

Independent movement may also allow for each ride vehicle 70 to enter a different room 72 in the attraction tower 12. For example, the ride vehicle 70*a* may enter the room 72*a* through the opening 74*a* at the same or a different time than the ride vehicle 70*b* may enter the room 72*b* through the opening 74*b*, while the ride vehicle 70*c* may enter the room 72*c* through the opening 74*d*. By way of further example, multiple ride vehicles 70 may be moved into the same room 72. For instance, the ride vehicle 70*a* may enter the room 72*a* through the opening 74*c* and the ride vehicle 70*b* may enter the room 72*a* through the opening 74*a*. During this time, the ride vehicle 70*c* may be at a different room 72 (e.g., room 72*b*), not in any of the rooms 72, or also be in room 72*a* through the opening 74*e*.

Figure 4:
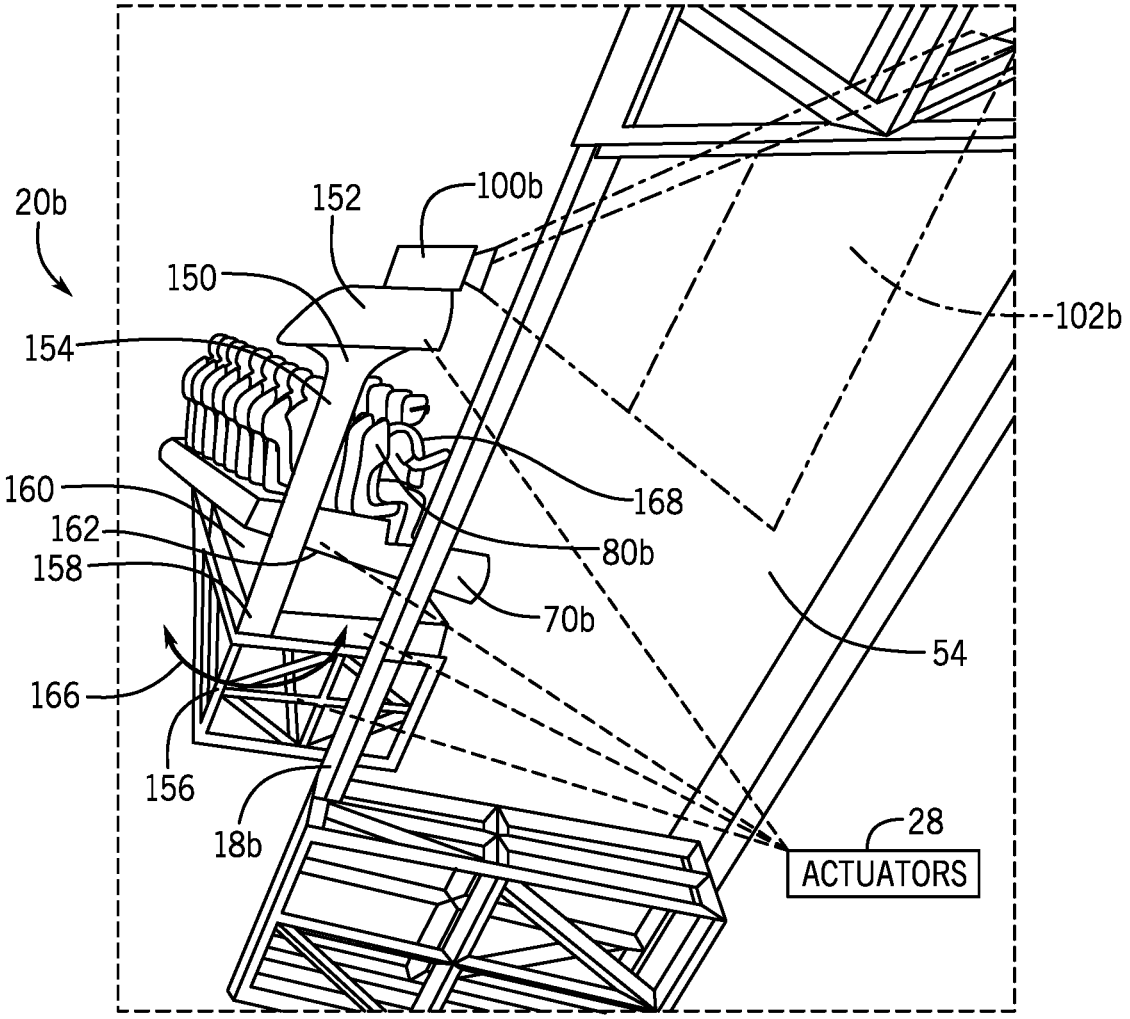
FIG. 4 is an expanded view of the motion base lift assembly of FIG. 3, in accordance with an aspect of the present disclosure.

To further illustrate the movement of the motion base lift assemblies 20 and the ride vehicles 70, FIG. 4 is an expanded view of the motion base lift assembly 20*b* of FIG. 3. As discussed above, the motion base lift assembly 20*b* may move along the frame 18*b* to change its vertical position. A mount 150 of the motion base lift assembly 20*b* may couple to the frame 18*b*. The mount 150 may include a horizontal component 152 and a vertical component 154. A side of the horizontal component 152 may be attached to the frame 18*b* and an opposite side of the horizontal component 152 may extend away from the frame 18*b*. The projector 100*b* may couple onto the horizontal component 152 (e.g., at a top side) and be positioned to face the wall 54 to project the image 102*b* onto the inside of the wall 54. The vertical component 154 may extend downward (e.g., along the frame 18*b*) at the side of the horizontal component 152 coupled to the frame 18*b*. The vertical component 154 may couple to an arm 156 at an attachment point 158. The arm 156 may be a rectangular or another shape that may couple with the vertical component 154 proximate to a side of the arm 156. The arm 156 may provide a platform for the ride vehicle 70*b* to rest on and attach with the motion base lift assembly 20*b*.

The ride vehicle 70*b* may couple to a ride vehicle base 160 at a coupling point 162 on a side of the ride vehicle base 160. The ride vehicle base 160 may couple to the arm 156 at an opposite of the ride vehicle base 160. As such, the ride vehicle 70*b* may couple to the motion base lift assembly 20*b* in a manner such that movement of the motion base lift assembly 20*b* may also move the ride vehicle 70*b*.

Additionally, respective actuators 28 may be located at the mount 150, at the attachment point 158, at the ride vehicle base 160, and/or at the coupling point 162. The actuators 28 may be communicatively coupled to the lift controller 22 such that the lift controller 22 is configured to activate the actuators 28 to move components of the motion base lift assembly 20. For example, the actuators 28 may translate the mount 150 along the frame 18*b* to adjust the vertical position of the motion base lift assembly 20*b*. The actuators 28 at the attachment point 158 may rotate the arm 156 in a direction 166 (e.g., clockwise or counterclockwise) about the vertical component 154. The rotation may be in a manner such that that the rotation does not result in contact between the frame 18*b* and the arm 156. Rotation of the arm 156 may then rotate the ride vehicle 70*b*. The actuators 28 may also rotate the ride vehicle 70*b* about the coupling point 162. For example, the coupling point 162 may be a ball-and-socket type connection between the ride vehicle 70*b* and the ride vehicle base 160 such that the actuators 28 may roll, pitch, and yaw the ride vehicle 70*b* about the coupling point 162. Furthermore, the actuators 28 may translate the ride vehicle base 160 along the arm 156. In one embodiment, the ride vehicle base 160 may use a telescoping method to move the ride vehicle 70*b*, such as to extend the ride vehicle 70*b* toward one of the rooms 72 and/or to retract the ride vehicle 70*b* out of the room 72. Since the ride vehicle 70*b* may be subject to multiple degrees of movement, the ride vehicle 70*b* may include seats with restraints 168 (e.g., over the shoulder restraints) that secure the passengers 80*b* to the ride vehicle 70*b* during operation of the ride system 10.

Figure 5:
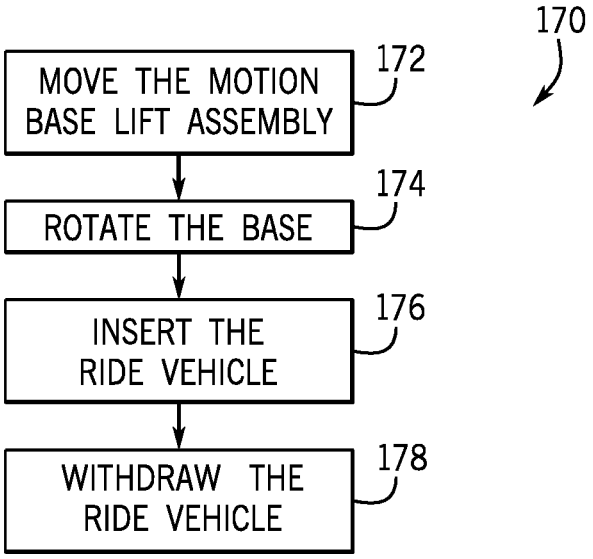
FIG. 5 is a flowchart of an embodiment of a method of transporting a ride vehicle from a first room to a second room in the ride system of FIG. 1, in accordance with an aspect of the present disclosure.

As discussed herein, the ride vehicle 70 may be inserted into and withdrawn from one of the rooms 72 several times throughout the operation of the ride system 10. In one embodiment, the ride vehicle 70 may be inserted into and withdrawn from different rooms 72 and/or different openings 74. Accordingly, the ride system 10 may position the ride vehicles 70 to align them with the rooms 72 and the openings 74. FIG. 5 illustrates an embodiment of a method 170 of transporting the ride vehicle 70 from one room 72 to another room 72, such as from the room 72*a* to the room 72*b*. All or some of the steps in the method 170 may be performed (e.g., coordinated) by the lift controller 22. At block 172, the motion base lift assembly 20 is moved, for example to change its height to align with one of the rooms 72. That is, the actuators 28 may move the motion base lift assembly 20 along the frame 18. As such, the corresponding ride vehicle 70 may be at substantially the same height as the room 72.

At block 174, the base 16 may rotate to align the ride vehicle 70 with one of the openings 74 of the room 72. In one embodiment, the ride vehicle 70 may remain at substantially the same height throughout the rotation of the base 16. In another embodiment, the ride vehicle 70 may be moved vertically during rotation of the base 16. As such, the acts associated with block 172 and block 174 may occur in a coordinated fashion (e.g., in concert). This may reduce the duration of time to align the ride vehicle 70 with the opening 74 and/or may enhance guest experience because of the induced motions.

After the ride vehicle 70 has been aligned with the opening 74, the motion base lift assembly 20 may extend the ride vehicle 70 to insert the ride vehicle 70 into the room 72 at block 176. That is, the actuators 28 may extend the ride vehicle base 160 to extend the ride vehicle 70 toward the room 72.

When the ride vehicle 70 is within the room 72, show elements within the room 72 may activate to further entertain the guests. After a period of time, the motion base lift assembly 20 may withdraw the ride vehicle 70 from the room 72 at block 178. For example, the actuators 28 may translate the ride vehicle base 160 to move the ride vehicle 70 out of and away from the room 72.

Although FIG. 5 shows the acts associated with blocks 172, 174, 176, 178 as being performed sequentially, in one embodiment, there may be certain actions that occur between acts associated with the blocks 172, 174, 176, 178 of the method 170. By way of example, the motion base lift assembly 20 may move along the frame 18, the base 16 may rotate, and the motion base lift assembly 20 may move again along the frame 18. Other actions, such as movement of the ride vehicle 70 (e.g., rolling about the coupling point 162) or movement of the arm 156 (e.g., rotation), may further enhance guest experience by generating sensations to the passengers 80 during transportation of the ride vehicle 70. These sensations may not be otherwise generated by a conventional elevator.

Figure 6:
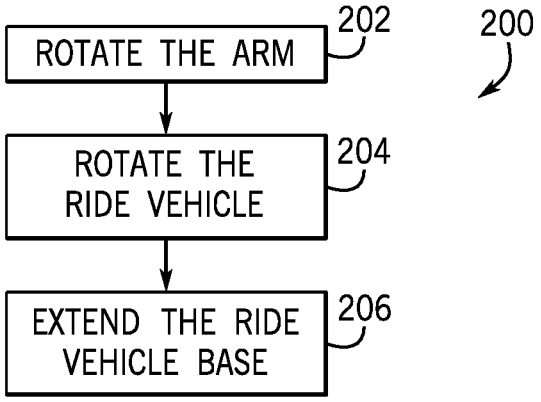
FIG. 6 is a flowchart of an embodiment of a method of inserting a ride vehicle into a room using the motion base lift assembly of FIGS. 3 and 4, in accordance with an aspect of the present disclosure.

Inserting and withdrawing the ride vehicle 70 with respect to the room 72 in accordance with blocks 176 and 178 may also include a series of actions. FIG. 6 is a flow diagram illustrating an embodiment of a method 200 to insert the ride vehicle 70 into the room 72. Prior to method 200, the ride system 10 may have aligned the ride vehicle 70 with the room 72 (e.g., including rotating the base 16, moving the motion base lift assembly 20 along the frame 18). At this time, the arm 156 and the ride vehicle 70 may be positioned in a manner such that the passengers 80 face the wall 54. Simultaneously, the projector 100 may be projecting an image 102 onto the wall 54 for the passengers 80 to view. When the ride vehicle 70 is aligned with the room 72, the arm 156 may rotate, at block 202. For example, the arm 156 may rotate 90 degrees about the vertical component 154 such that the passengers 80 have been rotated 90 degrees as well.

At block 204, the passengers 80 are additionally rotated via rotation of the ride vehicle 70 about the coupling point 162. The ride vehicle 70 may be rotated 90 degrees such that the combination of the rotations of the arm 156 and the ride vehicle 70*b* has rotated the passengers 80 to now face the room 72.

When the passengers 80 are facing the room 72, the ride vehicle base 160 may then extend the ride vehicle 70 at block 206. The extending movement of the ride vehicle base 160 may insert the ride vehicle 70 into the room 72.

Although the method 200 shows the acts associated with blocks 202, 204, 206 as being performed in a certain sequence, in one embodiment, the acts associated with blocks 202, 204, 206 may be performed in a different sequence. For example, the acts associated with block 202 and block 204 may be switched such that rotating the ride vehicle 70 may occur before rotating the arm 156. Further, in another embodiment, some or all of the steps in the method 200 may be performed simultaneously. That is, the acts associated with block 204 and block 206 may occur simultaneously such that the ride vehicle 70 may rotate as it is also being extended by the ride vehicle base 160. Additionally, other movements may occur while blocks 202, 204, 206 are being performed. For example, the base 16 may be rotating and/or the motion base lift assembly 20 may be moving along the frame 18. Accordingly, method 200 may be performed while the ride vehicle 70 is still being aligned (e.g., at the same vertical level) with room 72. Some or all of the steps in the method 200 may be performed (e.g., coordinated) by the lift controller 22.

A method similar to method 200 may be utilized to withdraw the ride vehicle 70 from the room 72. For example, the method may still rotate the arm 156 and rotate the ride vehicle 70, but the rotation may be performed in the opposite direction as that shown in the respective blocks 202, 204. That is, the arm 156 may be rotated 90 degrees and the ride vehicle 70 may be rotated 90 degrees so that the passengers 80 are facing the wall 54, similar to the position prior to the start of method 200. Furthermore, instead of extending the ride vehicle base 160 at block 206, the method would retract the ride vehicle base 160. In one embodiment, this operation may occur before rotation of the arm 156 and/or rotation of the ride vehicle 70. As is the case with the method 200, some or all of the steps for withdrawing the ride vehicle 70 from the room 72 may be performed sequentially or simultaneously and may be performed (e.g., coordinated) by the lift controller 22.

Turning back to FIG. 3, each of the rooms 72 may include show elements to enhance guests' experience. For example, the show elements may be animatronic figures, projections, displays, other show elements, or any combination thereof that may activate, such as when a ride vehicle 70 enters the room 72. In one embodiment, the room 72 may also include different show elements relative to another room within the ride system 10. As such, passengers 80 may undergo a different experience when entering the different rooms 72. As an example, the passengers 80*a* may interact with show elements when entering room 72*a* and may then interact with different show elements when entering the room 72*b*. In a further embodiment, the passengers 80 may experience different show elements when entering the same room 72 at different times. For example, the room 72*a* may include two different sets of show elements. The ride vehicle 70*a* may enter the room 72*a* at a first time through the opening 74*a* and a first set of show elements may activate for the passengers 80*a* to experience. At a later time, the ride vehicle 70*a* may enter the room 72*a* at a second time through the opening 74*e* and a second set of show elements may activate for the passengers 80*a* to experience. Thus, the passengers 80*a* may experience two different sets of show elements and have different experiences despite entering the same room 72*a*.

Although FIG. 3 depicts each room 72 as open such that the ride vehicles 70 are visible to one another when inserted within the respective openings 74, in an alternate embodiment, one of the rooms 72 may be modified to be further divided into multiple separate rooms. For example, one of the rooms 72 may include walls and/or dividers such that a ride vehicle 70 (e.g., the ride vehicle 70*a*) is not visible to another ride vehicle 70 (e.g., the ride vehicle 70*b*) when both of the ride vehicles 70 are within the room 72. As such, the ride vehicles 70 may enter the separate rooms simultaneously such that the ride vehicles 70 are in the room 72 at the same time, but the ride vehicles 70 are not visible to one another. Additionally or alternatively, the same ride vehicle 70 may enter some or all of the separate rooms at different times of the ride operation. The separate rooms may include different elements and as such, the passengers 80 at the ride vehicles 70 that enter the respective separate rooms may undergo different experiences.

Figure 7:
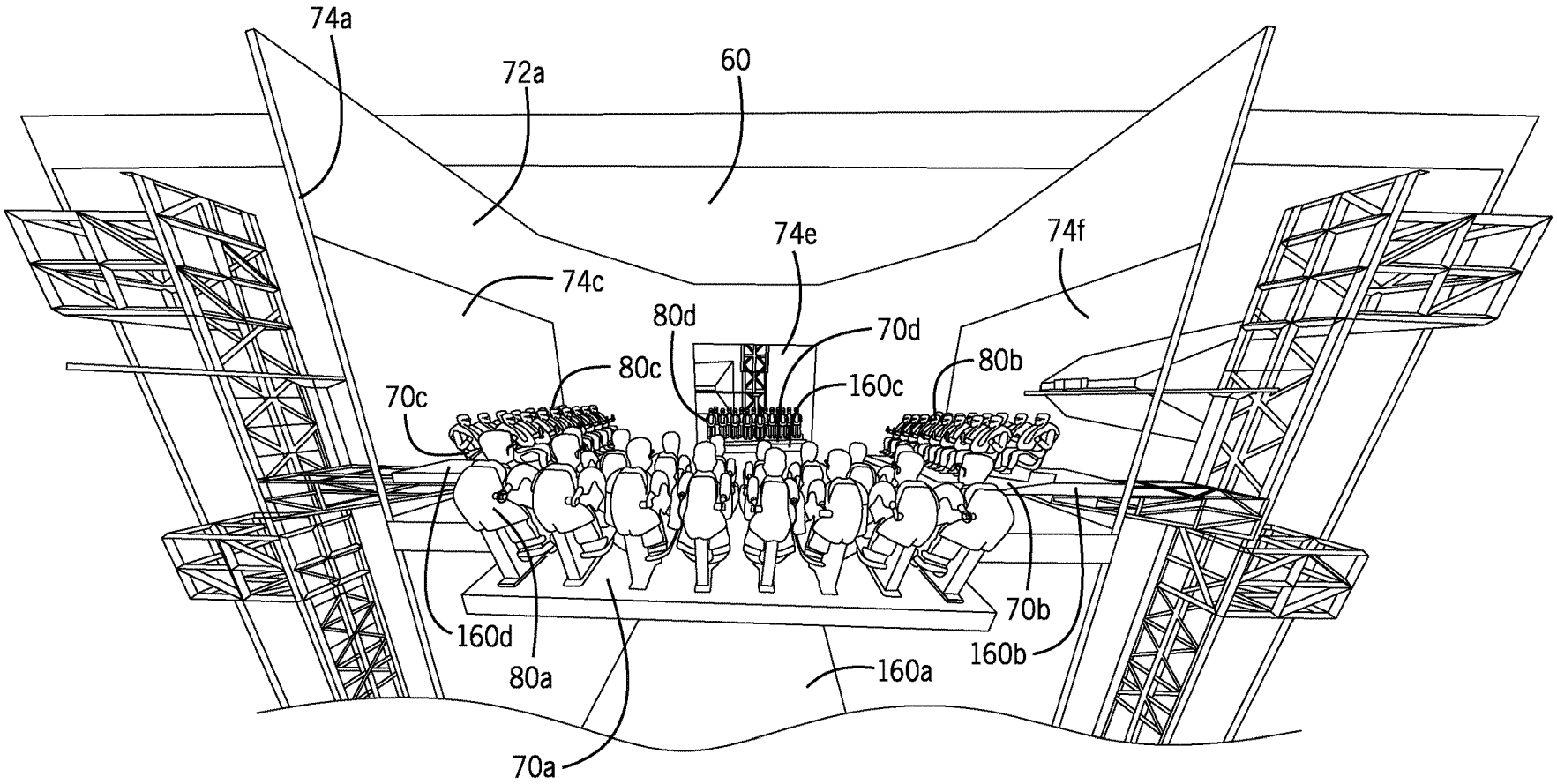
FIG. 7 is an elevation view of an embodiment of a room of the ride system of FIGS. 2 and 3, in accordance with an aspect of the present disclosure.

To illustrate the ride vehicles 70 when they are inside of the attraction tower 12, FIG. 7 is an embodiment of the ride vehicles 70*a*, 70*b*, 70*c*, 70*d* simultaneously located in the room 72*a*. In the illustrated embodiment, the ride vehicle 70*a* is inserted through the opening 74*a*, the ride vehicle 70*b* is inserted through the opening 74*f*, the ride vehicle 70*c* is inserted through the opening 74*c*, and the ride vehicle 70*d* is inserted through the opening 74*e*. In this embodiment, the ride vehicles 70 and the associated passengers 80*a*, 80*b*, 80*c*, 80*d* face toward a center of the room 72*a*. During this time, the room 72*a* may include show elements that enhance the experience of the passengers 80. For example, props, such as animatronic figures and/or projectors, may activate, for instance, when the ride vehicles 70 enter the room 72*a*. Moreover, when the ride vehicles 70 are inside of the room 72*a*, the ride vehicles 70 may also move (e.g., rotate, roll, pitch, yaw) in correspondence to activation of the animatronic figures and/or projections. This may further enhance the experience of the passengers 80. In one embodiment, the ride vehicles 70 may move in different ways relative to one another. For example, the ride vehicle 70*a* may rotate while the ride vehicle 70*b* yaws. Moreover, since the passengers 80 are at different positions in the room 72*a* relative to one another, they may have a different view of inside the room 72*a* and thereby view the show elements in the room 72*a* from different perspectives. Thus, the experience of the passengers 80 may differ from one another.

As mentioned above, insertion of the ride vehicles 70 into the room 72*a* may be accomplished by extending the respective ride vehicle bases 160*a*, 160*b*, 160*c*, 160*d*. In one embodiment, the ride vehicle bases 160 may slide forward to extend the ride vehicles 70 into the room 72*a*. In another embodiment, the ride vehicle bases 160 may utilize a telescoping mechanism to extend the ride vehicles 70 into the room 72*a*. The ride vehicle bases 160 may also retract the ride vehicles 70 to withdraw the ride vehicles 70 out of the room 72*a*. Furthermore, although FIG. 7 shows four ride vehicles 70*a*, 70*b*, 70*c*, 70*d* and four openings 74*a*, 74*c*, 74*e*, 74*f* in the room 72*a*, there may be any suitable number of ride vehicles 70 and openings 74 in the room 72*a*.

As set forth above, the ride system of the present disclosure may provide one or more technical effects useful in enhancing the guest experience during the operation of a ride system in an amusement park. For example, embodiments of the ride system may include an attraction tower disposed in an enclosure, where the attraction tower includes several rooms, each with show elements to entertain guests. The attraction tower may be surrounded by a lift system that includes a base which revolves around the tower. The base may include frames extending vertically from the base where each frame may be connected to a motion base lift assembly that includes a ride vehicle that passengers may be seated in. The lift system may transport the ride vehicles into rooms of the attraction tower to entertain the guests. The lift system may utilize several degrees of freedom to create sensations felt by guests that are not otherwise provided by conventional elevator systems that may include a limited number of degrees of freedom. For example, the lift system may generate rotational motion by rotating the base and/or the ride vehicle and also generate translational motion by moving the motion base lift assembly along the frame. The lift system may also move the ride vehicle in further degrees of freedom (e.g., roll, pitch, yaw). Furthermore, during transportation, the lift system may project a display onto the enclosure's walls. As such, the ride system may enhance a guest's experience when the ride vehicle is in one of the rooms of the attraction tower and when the ride vehicle is being transported into the rooms. The technical effects and technical problems in the specification are examples and are not limiting. It should be noted that the embodiments described in the specification may have other technical effects and can solve other technical problems.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A method of transporting a ride vehicle in an amusement park ride, comprising:

moving the ride vehicle vertically along a frame to a height using a motion base lift assembly, wherein the motion base lift assembly comprises a ride vehicle base coupled to the ride vehicle and an arm extending from the frame, the arm coupled to the ride vehicle base such that the ride vehicle base is configured to translate along the arm;

rotating, using a base, the ride vehicle around an attraction tower, the attraction tower comprising a plurality of rooms, wherein the base is configured to rotate about the attraction tower and is attached to the frame; and extending the ride vehicle into a room of the plurality of rooms by translating the ride vehicle relative to the arm.

2. The method of claim 1, comprising:

withdrawing the ride vehicle from the room via the motion base lift assembly by translating the ride vehicle base relative to the arm in a first direction;

moving the ride vehicle vertically along the frame to an additional height using the motion base lift assembly;

rotating the ride vehicle further around the attraction tower via the base; and extending the ride vehicle into another room of the plurality of rooms by translating the ride vehicle base relative to the arm in a second direction.

3. The method of claim 1, wherein moving the ride vehicle vertically along the frame and rotating the ride vehicle occur in concert.

4. The method of claim 1, comprising rotating the ride vehicle via the motion base lift assembly such that the ride vehicle faces a surface of an enclosure surrounding the attraction tower, and projecting an image onto the surface so that the image is displayed on the surface.

5. The method of claim 4, wherein rotating the ride vehicle via the motion base lift assembly rotates the ride vehicle about the frame.

6. The method of claim 1, comprising activating actuators to roll, pitch, yaw, rotate, or any combination thereof, the ride vehicle after extending the ride vehicle into the room.

7. The method of claim 1, comprising:

withdrawing the ride vehicle from the room by translating the ride vehicle base relative to the arm; and activating actuators to roll, pitch, yaw, rotate, or any combination thereof, the ride vehicle upon withdrawing the ride vehicle from the room.

8. The method of claim 1, comprising:

rotating the ride vehicle with respect to a vertical portion of the frame by rotating the arm of the motion base lift assembly about the frame.

9. The method of claim 1, comprising rotating, pitching, and/or yawing the ride vehicle about the ride vehicle base.

10. A controller comprising a tangible, non-transitory, computer-readable medium with computer-executable instructions that, when executed, are configured to cause one or more processors to:

control rotation of a ride vehicle around an attraction tower of an attraction system, wherein the attraction tower comprises a plurality of rooms;

control movement of the ride vehicle vertically along a frame of the attraction system using a motion base lift assembly to align the ride vehicle with a room of the plurality of rooms, wherein the motion base lift assembly comprises a ride vehicle base coupled to the ride vehicle and an arm extending from the frame, the arm coupled to the ride vehicle base such that the ride vehicle base is configured to translate along the arm; and control extension of the ride vehicle into the room by sliding the ride vehicle base relative to the arm.

11. The controller of claim 10, wherein the computer-executable instructions, when executed, are configured to cause the one or more processors to control rotation of the ride vehicle about the frame.

12. The controller of claim 10, wherein the computer-executable instructions, when executed, are configured to cause the one or more processors to:

control rotation of the ride vehicle about the frame to face a surface of an enclosure surrounding the attraction tower; and control projection of an image onto the surface via a projector mounted on the motion base lift assembly.

13. The controller of claim 10, wherein the computer-executable instructions, when executed, are configured to cause the one or more processors to control rotation of the arm about the frame to rotate the ride vehicle about the frame.

14. The controller of claim 10, wherein the computer-executable instructions, when executed, are configured to control rotation, pitch, and/or yaw of the ride vehicle about the ride vehicle base.

15. A method, comprising: moving a plurality of ride vehicles along a respective frame, wherein each respective frame is coupled to a base, each ride vehicle of the plurality of ride vehicles is coupled to a respective ride vehicle base, and each respective ride vehicle base is disposed on a respective arm; rotating the base around an attraction tower comprising a plurality of rooms, wherein rotating the base rotates the plurality of ride vehicles around the attraction tower; inserting a first ride vehicle of the plurality of ride vehicles into a first room of the plurality of rooms by translating a first ride vehicle base coupled to the first ride vehicle relative to a first arm; inserting a second ride vehicle of the plurality of ride vehicles into a second room of the plurality of rooms by translating a second ride vehicle base coupled to the second ride vehicle relative to a second arm; and withdrawing the first ride vehicle from the first room by translating the first ride vehicle base relative to the first arm while maintaining the second ride vehicle in the second room.

16. The method of claim 15, wherein moving the plurality of ride vehicles along the respective frame comprises moving the first ride vehicle along a first frame in a first vertical direction and moving the second ride vehicle along a second frame in a second vertical direction opposite the first vertical direction.

* * * * *